US009655478B2

(12) United States Patent
Muderlak et al.

(10) Patent No.: US 9,655,478 B2
(45) Date of Patent: May 23, 2017

(54) DISPENSER APPARATUS FOR DISPENSING LIQUID SOAP, LOTION OR OTHER LIQUID

(71) Applicant: DISPENSING DYNAMICS INTERNATIONAL, City of Industry, CA (US)

(72) Inventors: Todd Jeffrey Muderlak, Whitefish Bay, WI (US); Kenneth John Muderlak, Mulwaukee, WI (US)

(73) Assignee: Dispensing Dynamics International, City of Industry, CA (US)

( * ) Notice: Subject to any disclaimer, the term of this patent is extended or adjusted under 35 U.S.C. 154(b) by 0 days.

(21) Appl. No.: 14/155,551

(22) Filed: Jan. 15, 2014

(65) Prior Publication Data

US 2015/0157176 A1 Jun. 11, 2015

Related U.S. Application Data

(60) Provisional application No. 61/753,607, filed on Jan. 17, 2013.

(51) Int. Cl.
*A47K 5/12* (2006.01)

(52) U.S. Cl.
CPC ..... *A47K 5/1217* (2013.01); *A47K 5/1207* (2013.01)

(58) Field of Classification Search
CPC ..... A47K 5/1217; A47K 5/12; A47K 5/1207; A47K 5/1209; A47K 5/1215; A47K 5/1202; A47K 5/14
USPC ..... 222/181.3, 333, 52, 63, 214, 325, 182, 222/183
See application file for complete search history.

(56) References Cited

U.S. PATENT DOCUMENTS

| | | | | |
|---|---|---|---|---|
| 1,536,264 | A | 5/1925 | Pardee | |
| 4,079,861 | A | 3/1978 | Brown | |
| 4,463,876 | A | 8/1984 | Swallert | |
| 4,722,372 | A | 2/1988 | Hoffman et al. | |
| 4,932,562 | A | 6/1990 | Christine | |
| 4,967,935 | A | 11/1990 | Celest | |
| 5,100,030 | A | 3/1992 | Roggenburg, Jr. et al. | |
| 5,242,083 | A | 9/1993 | Christine et al. | |
| 5,249,718 | A | 10/1993 | Muderlak | |
| 5,255,822 | A | 10/1993 | Mease et al. | |
| 5,370,267 | A | 12/1994 | Schroeder | |
| 5,411,173 | A | 5/1995 | Weinstein | |
| 5,625,659 | A | 4/1997 | Sears | |
| 5,810,204 | A * | 9/1998 | Devlin et al. | 222/82 |
| 5,862,956 | A | 1/1999 | Brandenburg et al. | |
| 6,082,586 | A * | 7/2000 | Banks | 222/95 |
| 6,209,752 | B1 * | 4/2001 | Mitchell et al. | 222/63 |
| 6,305,580 | B1 | 10/2001 | Chen | |

(Continued)

FOREIGN PATENT DOCUMENTS

DE 29601918 U1 7/1997

OTHER PUBLICATIONS

PCT/US2015/011584, International Search Report and Written Opinion dated May 13, 2015, 14 pages.

*Primary Examiner* — Paul R Durand
*Assistant Examiner* — Charles P Cheyney
(74) *Attorney, Agent, or Firm* — Boyle Fredrickson, SC

(57) ABSTRACT

Dispenser apparatus for dispensing liquid soap or other liquid including dispensing structure for dispensing the liquid from a container, and an actuator for actuating the dispensing structure either by an electric motor or by manual movement of a cover of a cabinet holding the container and actuator.

14 Claims, 5 Drawing Sheets

(56) References Cited

U.S. PATENT DOCUMENTS

| | | | | |
|---|---|---|---|---|
| 6,347,724 | B1 | 2/2002 | Chen et al. | |
| 6,568,561 | B2 | 5/2003 | Studer et al. | |
| 6,607,103 | B2 * | 8/2003 | Gerenraich et al. | 222/183 |
| 6,688,499 | B2 | 2/2004 | Zhang | |
| 7,191,920 | B2 * | 3/2007 | Boll et al. | 222/333 |
| 7,278,554 | B2 * | 10/2007 | Armstrong | A47K 5/14 222/181.1 |
| 7,281,643 | B2 | 10/2007 | Lin | |
| 7,527,178 | B2 * | 5/2009 | Lewis | A47K 5/1204 222/105 |
| 7,540,397 | B2 | 6/2009 | Muderlak et al. | |
| RE42,707 | E | 9/2011 | Bunoz | |
| 8,302,812 | B2 * | 11/2012 | Reynolds | 222/63 |
| 8,342,365 | B2 * | 1/2013 | Snodgrass | 222/63 |
| 8,714,413 | B2 * | 5/2014 | Fuqua | G01F 11/22 222/333 |
| 8,807,398 | B2 * | 8/2014 | Sundberg | A47K 5/14 222/183 |
| 8,827,117 | B2 * | 9/2014 | Ho | 222/181.3 |
| 8,851,331 | B2 * | 10/2014 | Pelkey et al. | 222/181.3 |
| 8,905,265 | B2 * | 12/2014 | Muderlak et al. | 222/38 |
| 2002/0175182 | A1 * | 11/2002 | Matthews | A47K 5/1217 222/52 |
| 2005/0139612 | A1 * | 6/2005 | Matthews | A47K 5/16 222/190 |
| 2005/0247737 | A1 | 11/2005 | Armstrong | |
| 2009/0266842 | A1 * | 10/2009 | Snodgrass | 222/52 |
| 2009/0314800 | A1 | 12/2009 | Reynolds et al. | |
| 2010/0051640 | A1 | 3/2010 | Chen | |
| 2011/0056987 | A1 | 3/2011 | Proper et al. | |
| 2011/0101032 | A1 * | 5/2011 | Hsu | 222/309 |
| 2012/0111891 | A1 * | 5/2012 | McNulty et al. | 222/181.3 |

* cited by examiner

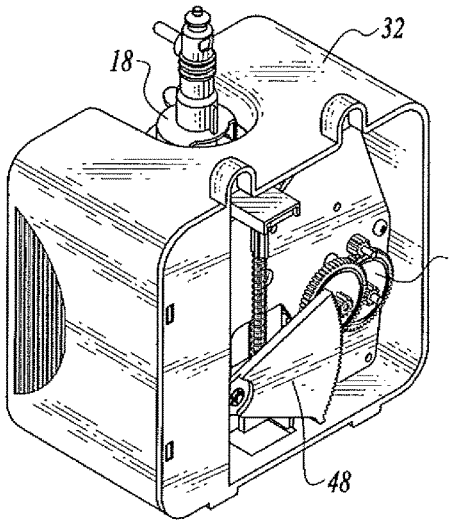
Fig. 5
Fig. 6
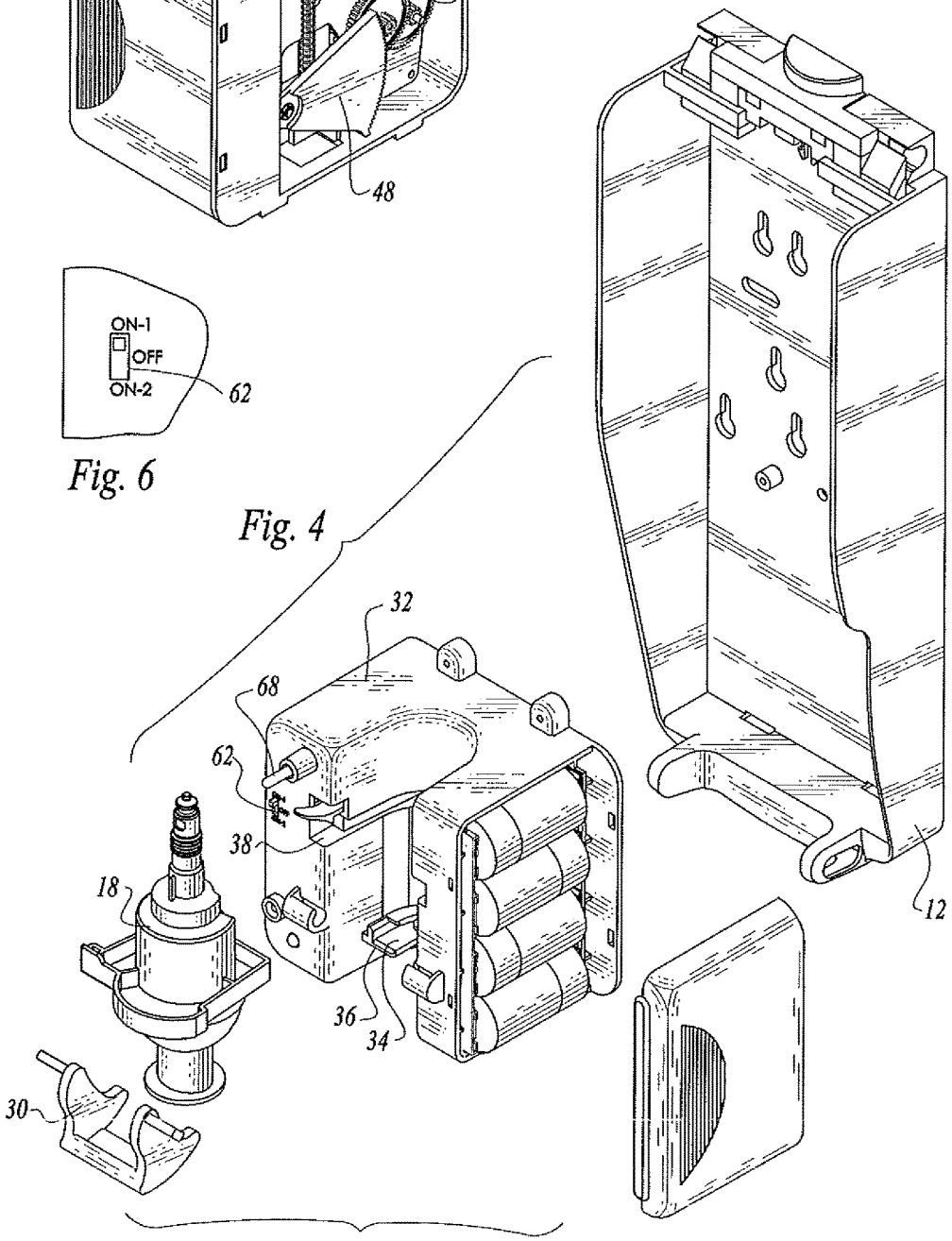

DISPENSER APPARATUS FOR DISPENSING LIQUID SOAP, LOTION OR OTHER LIQUID

This Application is based on and claims the benefit of U.S. Provisional Patent Application No. 61/753,607, filed Jan. 17, 2013.

TECHNICAL FIELD

This invention relates to dispenser apparatus for dispensing a liquid, the dispenser apparatus being a hybrid providing the ability to alternatively dispense soap or other liquid from a container either by an electric motor or by manually moving the cover of a cabinet holding the container.

BACKGROUND OF THE INVENTION

Wall mounted dispensers for holding liquid soaps, lotions and the like and for dispensing such liquids from a nozzle outlet or other opening are well known. Some dispensers utilize gravity to cause flow of liquid through the bottom opening or nozzle outlet when a valve is opened, either manually or by means of an electrically operated valve controller. The liquid to be dispensed may reside in a compartment or reservoir formed by the dispenser itself or in a separate container releasably connected to the dispenser.

It is also generally known to provide various mechanisms for pumping or exerting pressure on the liquid to facilitate dispensing. Such mechanisms differ and are conventionally used exclusively in either manually operated dispensers or electrically powered dispensers. Conventionally, both are not utilized in the same dispenser apparatus.

Dedication to an electrically operated system can have its drawbacks, one drawback in particular being inability to operate the dispenser manually in the event of loss of electrical power, either due to battery discharge or failure at an electrical outlet.

DISCLOSURE OF INVENTION

The present invention relates to dispenser apparatus for dispensing liquid soap, lotion or other liquid. The dispenser apparatus is in the nature of a hybrid incorporating a unique combination of structural elements which provides reliable operational ability either by manual power or electrical power through actuation of a pump associated with a liquid container.

The hybrid operation of the dispenser has a number of advantages. There is less reliance on batteries, and lessening of problems concerning infrared and related soap system maintenance issues. The hybrid function ensures that patrons always have soap, resulting in less complaints and related frustration taken out on dispensers (vandalism). For the end user, when soap is in the container, there will always be access to soap whether during electrical powered (auto) operation or manual operation.

The dispenser apparatus includes a cabinet defining an interior for holding a container containing liquid and dispensing structure connected to the container to dispense liquid from the container. The cabinet includes a housing and a cover movably connected to the housing.

Actuator mechanism is connected to the cabinet for operating the dispensing structure to dispense liquid from the container when the container and dispensing structure are held within the interior.

The dispenser apparatus includes an electric motor. The electric motor and the cover are selectively alternatively cooperable with the actuator mechanism to cause the actuator mechanism to operate the dispensing structure and dispense liquid from the container.

Other features, advantages and objects of the present invention will become apparent with reference to the following description and accompanying drawings.

BRIEF DESCRIPTION OF DRAWINGS

FIG. 4 is an exploded, perspective view illustrating operational components of the dispenser apparatus including a pump, the electronic module, and a cover operable pump actuator element removed from the housing;

FIG. 5 is a rear, perspective view of the electronic module and pump connected to the electronic module;

FIG. 6 is an enlarged view of a control switch incorporated in the dispenser apparatus;

BEST MODE FOR CARRYING OUT THE INVENTION

Figure 3:
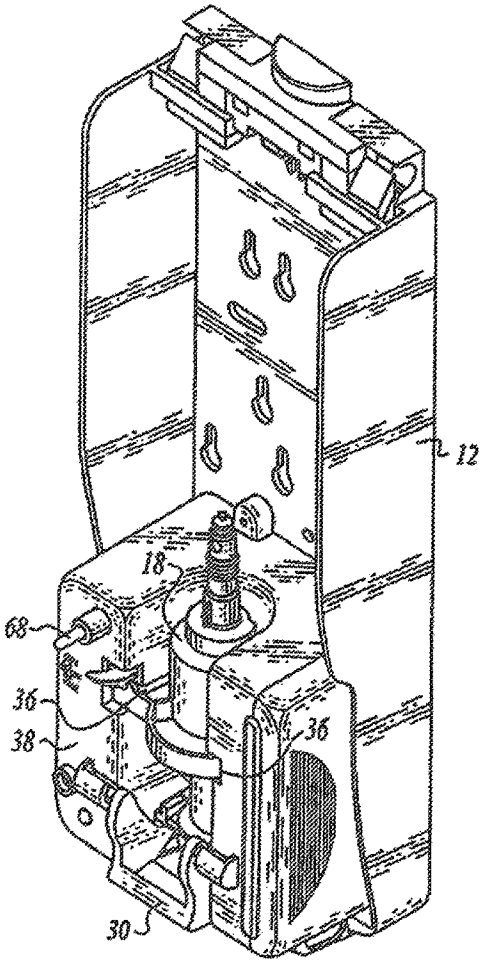
FIG. 3 is a front, perspective view illustrating the cover removed from the housing, dispensing structure in the form of a pump connected to the housing, and related structure including an electronic module.
Figure 2:
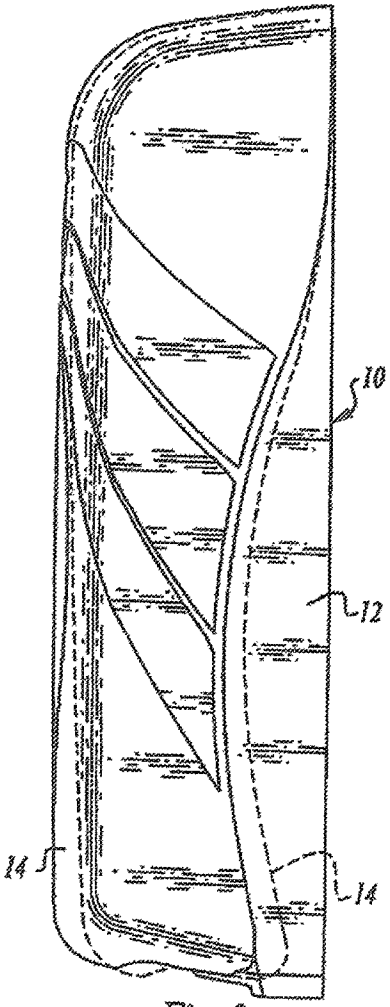
FIG. 2 is a side, elevational view illustrating the cover in two alternative positions relative to the cabinet housing respectively in solid and broken lines.
Figure 1:
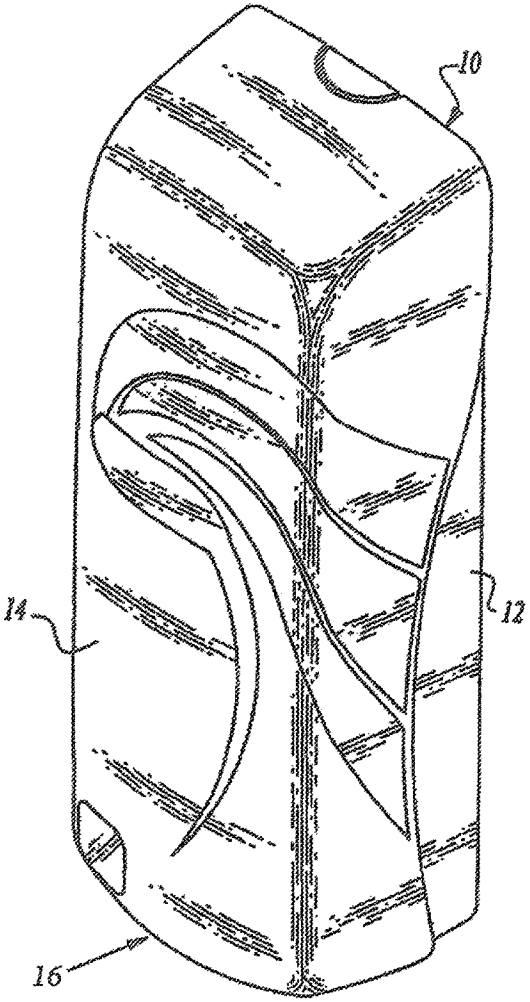
FIG. 1 is a front, perspective view of the cabinet of the dispenser apparatus showing the cover thereof being moved to actuating position by a force applied thereto in the direction of the illustrated arrow.

Referring now to the drawings, reference numeral 10 is employed to identify the cabinet of dispenser apparatus constructed in accordance with the teachings of the present invention. The dispenser apparatus is for dispensing liquid soap, however it may be employed to dispense other liquids such as lotion.

Figure 9:
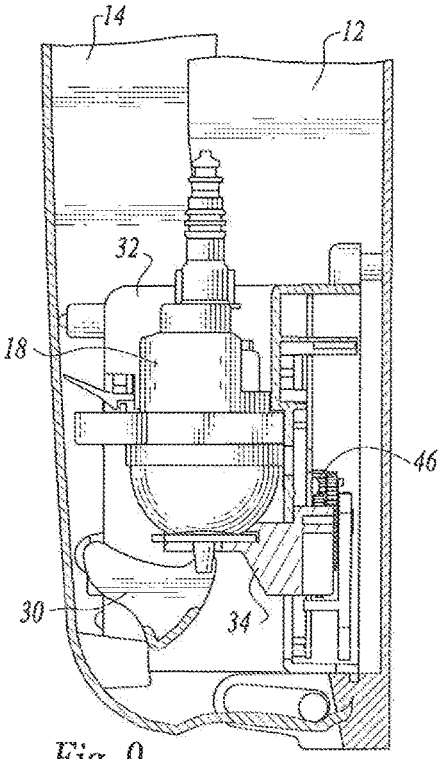
FIG. 9 is a view similar to FIG. 7, but illustrating the cover in engagement with the manually operable pump actuator element and the cover operable pump actuator element having actuated the pump.

The cabinet 10 includes a housing 12 and a cover 14 pivotally connected to the housing by hinge structure of any suitable type located at the adjoining upper ends of the cover and housing. In the arrangement illustrated, the hinge comprises receptacles located at the top of the housing for receiving hinge members (not shown) at the top of the cover which are snapped into place in the receptacles. If desired, the cover may be completely removed from the housing to provide access to the housing interior. FIGS. 1, 2, 7 and 9 show the cover connected to the housing. The cover may be pivotally moved between the normal (non-use) position shown in FIG. 2 in solid lines to the actuator position shown in dash lines in FIG. 2 by applying a manual force, as shown by arrow 16 in FIG. 1, the latter figure and FIG. 7 also showing the cover in its normal (non-use) position. FIG. 9 shows the cover in the actuator position.

The cabinet defines an interior for holding a container containing liquid soap and dispensing structure 18 connected to the container to dispense liquid from the container. In the arrangement illustrated, the dispensing structure 18 is in the form of a liquid pump, but principles of the present invention are applicable with other types of dispensing structure such as a dispensing valve structure. The dispenser apparatus suitably includes lock-out structure allowing only specific containers and dispensing valve structure combinations to be utilized. For example, the outer configurations of the container and the dispensing structure may be required to match the shapes of the recesses or other structural features of the housing. Electronic lock-outs and/or other types of mechanical lock-outs may be employed in the system as well so that only specific refills may be employed in the system.

Figure 16:
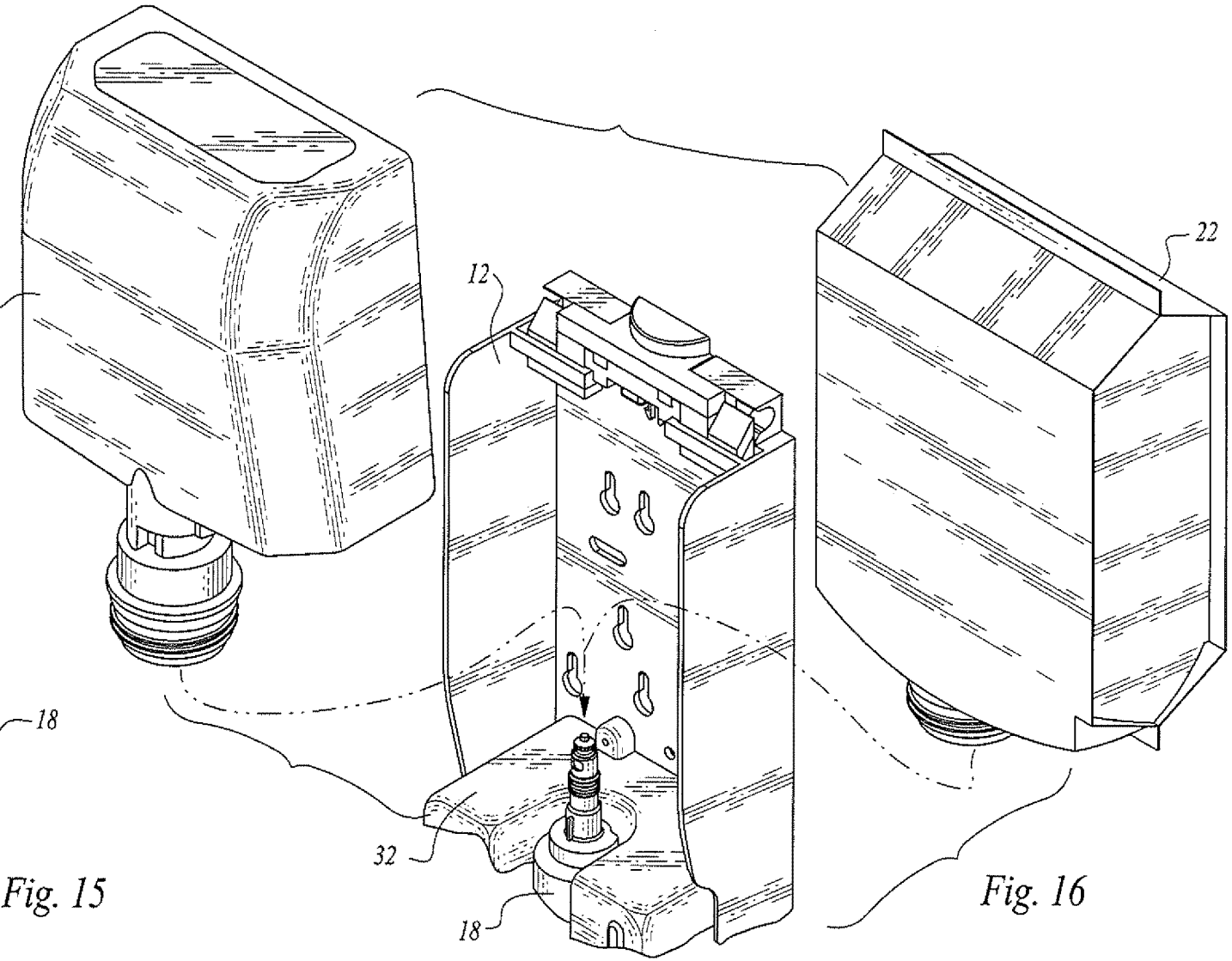
FIG. 16 is a perspective, exploded view illustrating two alternatively useable representative types of liquid containers that may be used with the pump
Figure 15:
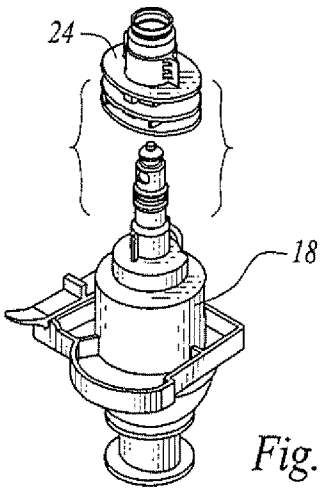
FIG. 15 is a perspective, exploded view of the pump and an adaptor utilized to adapt the pump to different types of soap containers.

FIG. 16, for example, illustrates two types of containers 20, 22 which may be used with the dispensing apparatus. One may for example be a semi-rigid container and the other a collapsible bag-type container. FIG. 15 provides an illustration of how an adaptor 24 may be applied to the pump inlet to allow its use with different container outlet structures.

The dispenser apparatus includes actuator mechanism connected to the cabinet for operating the dispensing structure to dispense liquid from the container when the container and dispensing structure are installed within the housing.

The actuator mechanism includes actuator structure 30 which is pivotally mounted relative to the housing and more particularly directly pivotally attached to a module 32 that is selectively removably connected to the housing. This may be seen in FIG. 3, for example, which illustrates the module 32 installed in place in the housing. Actuator structure 30 is positioned so that it is engageable by the cover 14 when the cover is moved from its normal (non-use) position to the actuator position shown in FIG. 9, for example, wherein the actuator structure 30 has been moved and rotated as illustrated by the arrow in FIG. 7.

The actuator mechanism also includes actuator structure 34 which is mounted for vertical slidable movement on the module 32. Pump 18 is releasably connected to actuator structure 34, a lower portion of the pump structure disposed in an open-ended slot 36 of the actuator structure 34. The main body or upper portion of the pump is positioned in and held in a slot 38 defined by the module. Actuator structure 34 is engaged by actuator structure 30 during inward movement of the cover and responsive to movement of the actuator structure 30 caused by movement of the cover to move upwardly along with the lower pump portion held thereby and actuate the pump 18 and dispense liquid therefrom. FIG. 9 shows the pump having been actuated. Soap or other liquid from the pump will exit the cabinet 10 through a bottom opening defined by the cover and housing. The afore-described structure provides for dispensing by manual application of force to the cover.

The dispenser apparatus is in essence a hybrid, also incorporating structure providing dispensing through utilization of an electric motor. The electric motor is identified by reference numeral 40 and incorporated in the module 32 along with batteries 42 for energizing the motor. The electric motor is operatively associated with actuator structure 34 upon energization thereof to move the actuator structure 34 relative to the pump in the manner previously described with reference to actuator structure 30 used for that purpose to actuate the pump and dispense liquid therefrom.

A gear train 46 is operatively positioned between the electric motor and actuator structure 34. The gear train includes a gear member 48 which engages the actuator structure. Rotation of the gears of the gear train, including gear member 48, will cause the actuator structure 34 to move upwardly. This is accomplished by a projection 50 on the gear member 48 engaging and bearing against the bottom of actuator structure 34 and causing upward movement thereof when gear member 48 rotates. FIGS. 7-10 provide an illustration of the immediately aforesaid operation.

Figure 7:
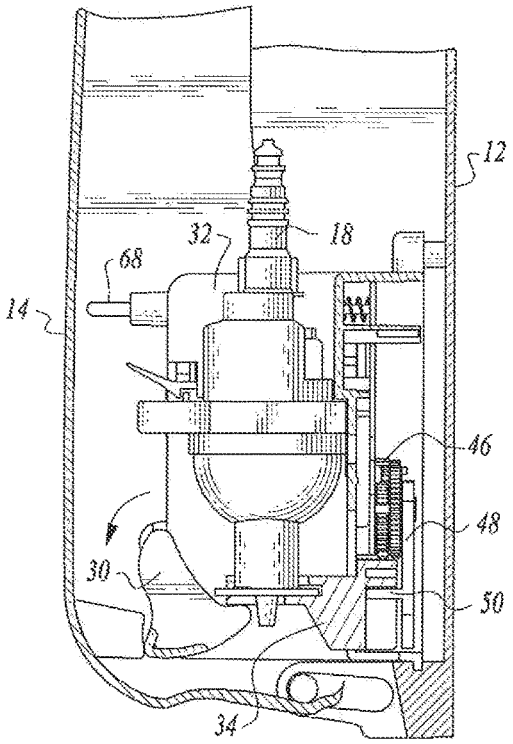
FIG. 7 is a side, elevational, cross-sectional view illustrating the cover in the position shown in FIG. 1 and being moved toward actuating position and in engagement with the cover operable pump actuator element and prior to actuation of the pump.
Figure 8:
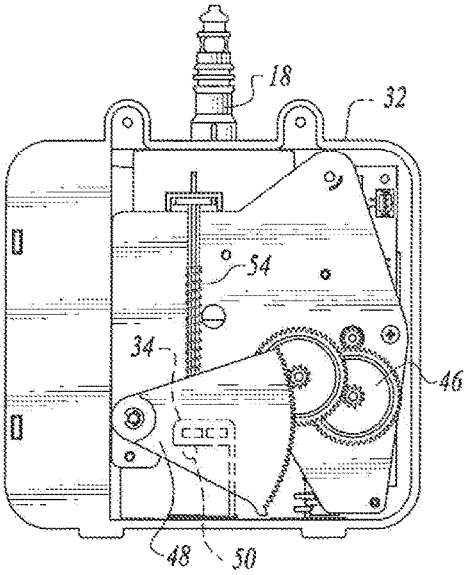
FIG. 8 is a rear, elevational view of the electronic module and showing the relative positions assumed by components thereof when the cover and cover operable pump actuator element are in the positions shown in FIG. 7
Figure 10:
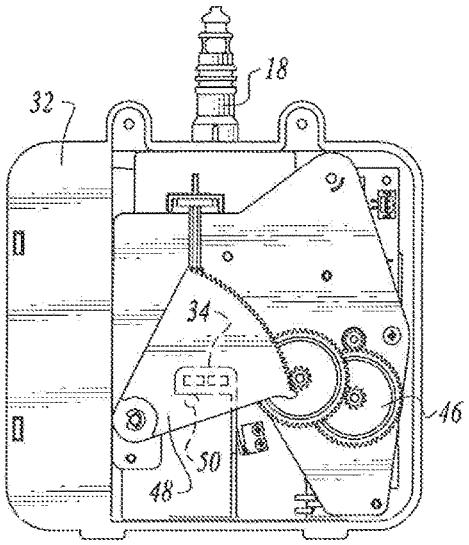
FIG. 10 is a view similar to FIG. 8 showing the relative positions assumed by components of the electronic module when the cover and cover operable pump actuator element are in the positions shown in FIG. 9.
Figure 11:
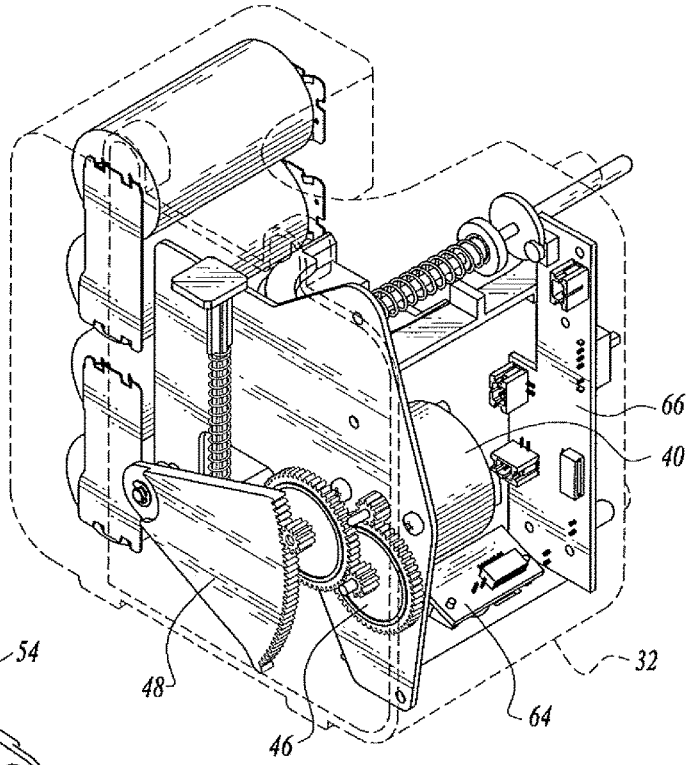
FIG. 11 is a rear, perspective view depicting in dash lines the outer outline of the electronic module and showing selected operational components of the electronic module in solid lines.
Figure 13:
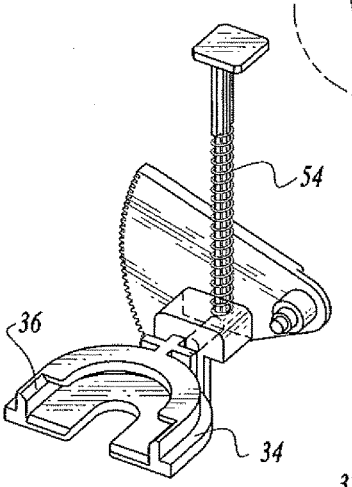
FIG. 13 is an enlarged perspective view of an actuator structure, a gear member, and biasing structure of the electronic module.

After the pump has dispensed the quantity of soap or other liquid desired, the motor and the gear train are reversed and gear member 48 returns from its position shown in FIGS. 9 and 10 to its original position as shown in FIGS. 7 and 8. This may be accomplished effectively by utilizing a biasing structure 54 including a fixed rod 56 to which actuator structure 34 is connected and a biasing spring 58 which continuously biases actuator structure 34 and thus gear member 38 downwardly. Alternatively, electrical control circuitry may be used for this purpose.

Figure 14:
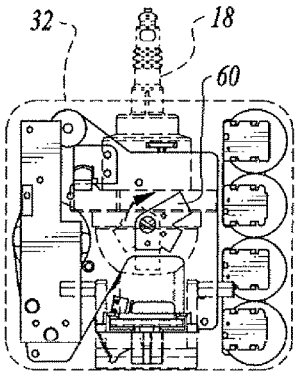
FIG. 14 is a rear, elevational view of the electronic module illustrating the outer outline thereof and the pump in dash lines, and other parts thereof, including a mechanism for adjusting the dose of the pump, in solid lines.
Figure 12:
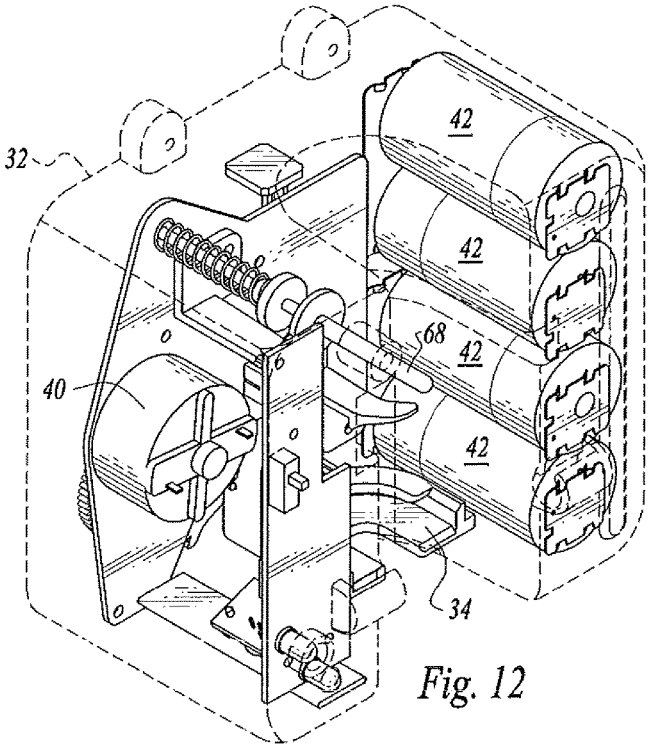
FIG. 12 is a front, perspective view depicting in dash lines the outer outline of the electronic module and showing selected operational components of the electronic module in solid lines.

The amount of liquid dispensed from the pump 18 can be adjusted by changing the distance that the actuator structure 34 moves upwardly. One approach for accomplishing this is shown in FIG. 14 wherein a stop 60 having stop elements of different lengths may be rotated and fixed in a desired position to limit the stroke or upward movement of the actuator 34 by engaging same. A simple screw driver may be utilized to make this adjustment or such an operation may be accomplished by using a switch such as switch 62 shown in FIG. 6 to provide the appropriate adjustment internally. An off position on the switch can be used to eliminate use of the electric motor operation altogether so that only the cover actuation mode can be utilized.

The module 32 contains appropriate control circuit boards 64, 66 utilized to control the various functions of the dispenser apparatus functioning as an electronic module. The module is preferably designed to allow for easy placement for alternative cover/housing designs that leverage the same size refills and pumps. In the arrangement illustrated, a spring biased projection 68 is incorporated on the electronic module to engage the inside surface of the cover 14 and continually bias the cover outwardly to its normal or non-use position.

The invention claimed is:

1. A dispenser apparatus for dispensing liquid soap, lotion or other liquid, said dispenser including, in combination:

a dispenser cabinet defining an interior for holding a container containing liquid and a dispensing structure connected to said container to dispense liquid from the container, said cabinet including a housing and a cover that is movably connected to said housing at respective upper ends thereof such that the cover can move in opposite lateral directions toward and away from the housing;

an actuator mechanism in the cabinet interior for operating said dispensing structure to dispense liquid from the container responsive to movement of the cover toward said housing, the actuator mechanism including a first actuator mechanism and being responsive to engagement and manual movement of the cover relative to the housing to effectuate rotation of the first actuator mechanism about a horizontal axis and relative to the dispensing structure and thereby manual operation of the dispensing structure to dispense liquid from the container, and the actuator mechanism being operable to effectuate powered operation of the dispensing structure to dispense liquid from the container when a motor is operable such that the dispenser apparatus is concurrently configured to effectuate one of manual or automatic operation of the dispensing structure to dispense liquid from the container when the container and dispensing structure are held within the interior;

wherein the dispensing structure is a pump and wherein the first actuator structure is movably mounted so as to pivot relative to the housing and responsive to engagement by and movement of the cover to move relative to the housing and the second actuator structure engaging the pump and axially movable relative to the pump and to the housing, the second actuator structure engaged by the first actuator structure during movement of the cover to manually actuate the pump and dispense liquid therefrom; and an electric motor operatively associated with the second actuator structure upon energization thereof to move the second actuator structure relative to the pump and the housing to actuate the pump and dispense liquid therefrom.

2. The dispenser apparatus according to claim 1 including a gear train between said electric motor and said second actuator structure.

3. The dispenser apparatus according to claim 2 wherein said gear train includes a gear member engaging said second actuator structure, said second actuator structure movable toward said pump responsive to rotation of said gear member.

4. The dispenser apparatus according to claim 3 additionally including biasing means for reversing rotational direction of said gear member and for moving said second actuator structure away from said pump after actuation of said pump and dispensing of liquid therefrom.

5. The dispenser apparatus according to claim 4 additionally including adjustable stop means limiting movement of said second actuator structure for controlling the amount of liquid dispensed from said pump during actuation thereof by said second actuator structure.

6. The dispenser apparatus according to claim 3 wherein said electric motor and said gear train are incorporated in a module selectively removable from said housing.

7. A dispenser apparatus for dispensing liquid soap, lotion, or other liquid, the dispenser apparatus comprising:

a cabinet defined by a cover that is movably connected to a housing with respect to an upper end and a lower end of the cover and housing, the housing and cover cooperating with one another to define an interior facing cavity configured to substantially enclose a liquid material container within the cabinet;

a dispensing structure disposed in the cavity and configured to cooperate with a liquid material container disposed in the cavity;

an actuator assembly disposed in the cavity and having a power operated dispensing assembly engaged therewith, the actuator assembly configured to actuate the dispensing structure to dispense liquid material from the cabinet in response to manual translation of the cover in a lateral direction that is transverse to a longitudinal direction that extends between the upper and the lower end of the cover toward the housing which causes manual rotation of a first actuator structure about an axis that is transverse to the longitudinal direction and the lateral direction such that the dispenser apparatus is concurrently configured to selectively effectuate one of manual operation of the dispensing structure to dispense a dose of liquid material from the cabinet and automatic operation of the dispensing structure to dispense the dose of the liquid material from the cabinet when the power operated dispensing assembly is actuated and operable;

wherein the first actuator structure extends between the cover and the dispensing structure and a second actuator structure is disposed between the dispensing structure and a motor associated with the power operated dispensing assembly, the second actuator structure configured to actuate the dispensing structure response to operation of the motor; and a gear train disposed between the motor and the second actuator structure.

8. The dispensing apparatus of claim 7 wherein the first actuator structure and the second actuator structure cooperate with one another such that the second actuator structure is movable in response to manual movement of the first actuator structure and independently moveable relative to the first actuator structure in response to operation of the motor.

9. The dispensing apparatus of claim 7 further comprising a first biasing assembly configured to bias the cover away from the housing and the actuator assembly toward a ready to dispense position and a second biasing assembly configured to bias the second actuator structure of the actuator assembly toward a ready to dispense position.

10. A method of forming a dispenser that includes a cover that is connected to a housing such that the housing and the cover cooperate with one another to define a cavity shaped to receive a liquid material container and such that the cover extends in a longitudinal direction and is moveable relative to the housing about opposite longitudinal ends of the cover and the housing associated with opposite longitudinal ends of the dispenser, a dispensing structure, and an actuator assembly within the cavity for dispensing liquid soap, lotion or other liquid materials from the dispenser, the method comprising:

engaging the actuator assembly with the cover and the dispensing structure such that manual translation of the cover relative to the housing and the opposite longitudinal ends of the cover and the housing causes rotation of a first portion of the actuator assembly disposed near a lower longitudinal end of the dispenser opposite an upper longitudinal end of the dispenser and relative to the cover and the housing causes manual operation of the dispensing structure in a direction aligned with a longitudinal axis of the dispenser to dispense a dose of a liquid material from the dispenser and operation of a power drive system having a gear train that is disposed between a motor and a second portion of the actuator assembly that is independently movable relative to the first portion of the actuator assembly such that operation of the power drive system causes automatic operation of the dispensing structure to dispense the dose of the liquid material from the dispenser and wherein manual or automatic operation of the dispensing structure are selectively initiated to dispense a dose of the liquid material from the dispenser.

11. The method of claim 10 further comprising biasing each of the first portion and the second portion of the actuator assembly toward a ready-to-dispense position.

12. The method of claim 11 further comprising providing a separable connection between the first portion and the second portion of the actuator assembly.

13. The method of claim 12 further comprising translating the second portion of the actuator assembly in the direction aligned with the longitudinal axis of the dispenser in response to manual operation of the first portion of the actuator assembly and translating the second portion of the actuator assembly in the direction aligned with the longitudinal axis of the dispenser independent of the first portion of the actuator assembly during operation of the power drive system.

14. The method of claim 10 further comprising providing an adjustable stop configured to limit operation of the gear train.

* * * * *